US007246461B2

(12) United States Patent
Wooden

(10) Patent No.: US 7,246,461 B2
(45) Date of Patent: Jul. 24, 2007

(54) TELESCOPIC SIGHT ADJUSTMENT DEVICE

(76) Inventor: James Dale Wooden, 39135 E. 210 Ave., Pattonsburg, MO (US) 64670

( * ) Notice: Subject to any disclaimer, the term of this patent is extended or adjusted under 35 U.S.C. 154(b) by 287 days.

(21) Appl. No.: 10/986,516

(22) Filed: Nov. 10, 2004

(65) Prior Publication Data

US 2006/0096149 A1 May 11, 2006

(51) Int. Cl.
*F41G 1/387* (2006.01)

(52) U.S. Cl. ..... 42/125; 359/422

(58) Field of Classification Search ..... 102/124, 102/125, 126; 359/421, 422
See application file for complete search history.

(56) References Cited

U.S. PATENT DOCUMENTS 5,180,875 A 1/1993 Berry, Jr. et al.
5,276,554 A 1/1994 Nassivera
5,388,005 A * 2/1995 Wilson ..... 359/694
5,521,757 A 5/1996 Olson
5,528,847 A 6/1996 Fisher et al.
5,738,251 A 4/1998 Schuckmann
5,924,211 A 7/1999 Wambold, Jr. et al.
5,930,934 A 8/1999 Fisher et al.
6,104,531 A 8/2000 Dross
6,519,083 B2 * 2/2003 Heinrich ..... 359/422

* cited by examiner

*Primary Examiner*—Stephen M. Johnson
(74) *Attorney, Agent, or Firm*—Mark E. Brown

(57) ABSTRACT

A motorized telescopic adjustment device 10 is disclosed which is connected to an adjustment ring 6 of a telescopic sight 4 for firearms 2 or the like including: a battery 12, a motor 14 with a switch 16 electronically interconnected to power the motor 14, a drive 30 interconnected to the motor 14 and the adjustment ring 6 to adjust the telescopic sight adjustment ring 6, a support bracket assembly 40 adapted to adjustably mount the device 10 on the telescopic sight 4 and a motor connection 60 for securably mounting the motor 14 on the support bracket assembly 40. The support bracket assembly 40 includes a front and a rear mounting bracket subassemblies 42, 44 which are adjustable along a rod 50 which extends between the front and rear mounting bracket subassemblies 42, 44, the front mounting bracket subassembly 42 including a protruding boss 49 for receiving the rod 50. In addition, the drive 30 includes a pulley 34 and belt 32, the pulley 34 mounted on a shaft 36 extending outwardly from the motor 14, the pulley 34 being operably interconnected to the belt 32 wherein the belt 32 encircles the pulley 34 and the adjustment ring 6 of the telescopic sight 4 manipulating a characteristic of the telescopic sight 4.

14 Claims, 10 Drawing Sheets

TELESCOPIC SIGHT ADJUSTMENT DEVICE

BACKGROUND OF THE INVENTION

1. Field of the Invention

The present invention relates generally to a device for adjusting a firearm telescopic sight, and in particular to an improved controllable, motorized adjustment device.

2. Description of the Related Art

Various weapons, including firearms, are often equipped with telescopic sights to assist in more accurate aiming. A typical telescopic sight has adjustment features including zoom and focus controlled by an ocular ring surrounding the sight. These adjustments allow for more accurate targeting of the weapon. Before firing the weapon, the user must adjust the telescopic sight's adjustable characteristics such as zoom and focus to provide for accurate targeting. In some circumstances this is performed multiple times, such as when inspecting an area for possible targets and when making necessary adjustments for distances to any discovered targets. In some circumstances, shooters wait for targets to come within range. When targets actually come within range, it is often necessary to manually adjust the magnification and focus settings of the telescopic sights.

Two common problems with telescopic sights are movement and time. A challenge of aiming at live targets is that they often move during the targeting of the weapon. Aiming the weapon at the target often requires multiple adjustments to the weapon and the telescopic sight. The adjustment of the telescopic sight may affect the targeted weapon and require readjustments to the telescopic sight which cause the user to move from a "ready" position. This change in position causes the user to physically move his or her hands to adjust the telescopic sight. In addition, the readjustment of the telescopic sight also causes movement of the weapon. These adjustments and readjustments to the telescopic sight require time and also cause delay in the discharge of the weapon. Time is often a critical factor when firing weapons at live targets, because the targets are susceptible to movement at any given time. Any necessary adjustments to the telescopic sight can easily take longer than the duration the live target is within the range of the weapon. Also, the movement which may be necessary to target the weapon may alert the live target to the user's presence. Therefore, it would be advantageous to have a motorized sight adjustment which does not require additional movement of the weapon and reduces the time necessary to aim the weapon at a target.

Prior art attempts to addresses these problems include Berry U.S. Pat. No. 5,331,999, which relates to a scope adjustment for firearms with a thumb wheel for focusing the telescopic sight with the user's trigger hand. Nassivea U.S. Pat. No. 5,276,554 relates to a lever system for a variable magnification adjustment device. Olson U.S. Pat. No. 5,521,757 discloses a lever system used to rotate the adjustment ring of a variable power telescope. However, heretofore there has not been available a telescopic sight adjustment device with the advantages and features of the present invention.

SUMMARY OF THE INVENTION

In the practice of the present invention, a motorized telescopic adjustment device is provided for mounting on a firearm. The telescopic adjustment device includes a power supply, a motor, a motor connection, a drive and a support bracket assembly. The motor connection connects the motor to the power supply and the drive extends from the motor and connects the motor to the telescopic adjustment device.

DETAILED DESCRIPTION OF THE PREFERRED EMBODIMENTS

I. Introduction and Environment

Figure 1:
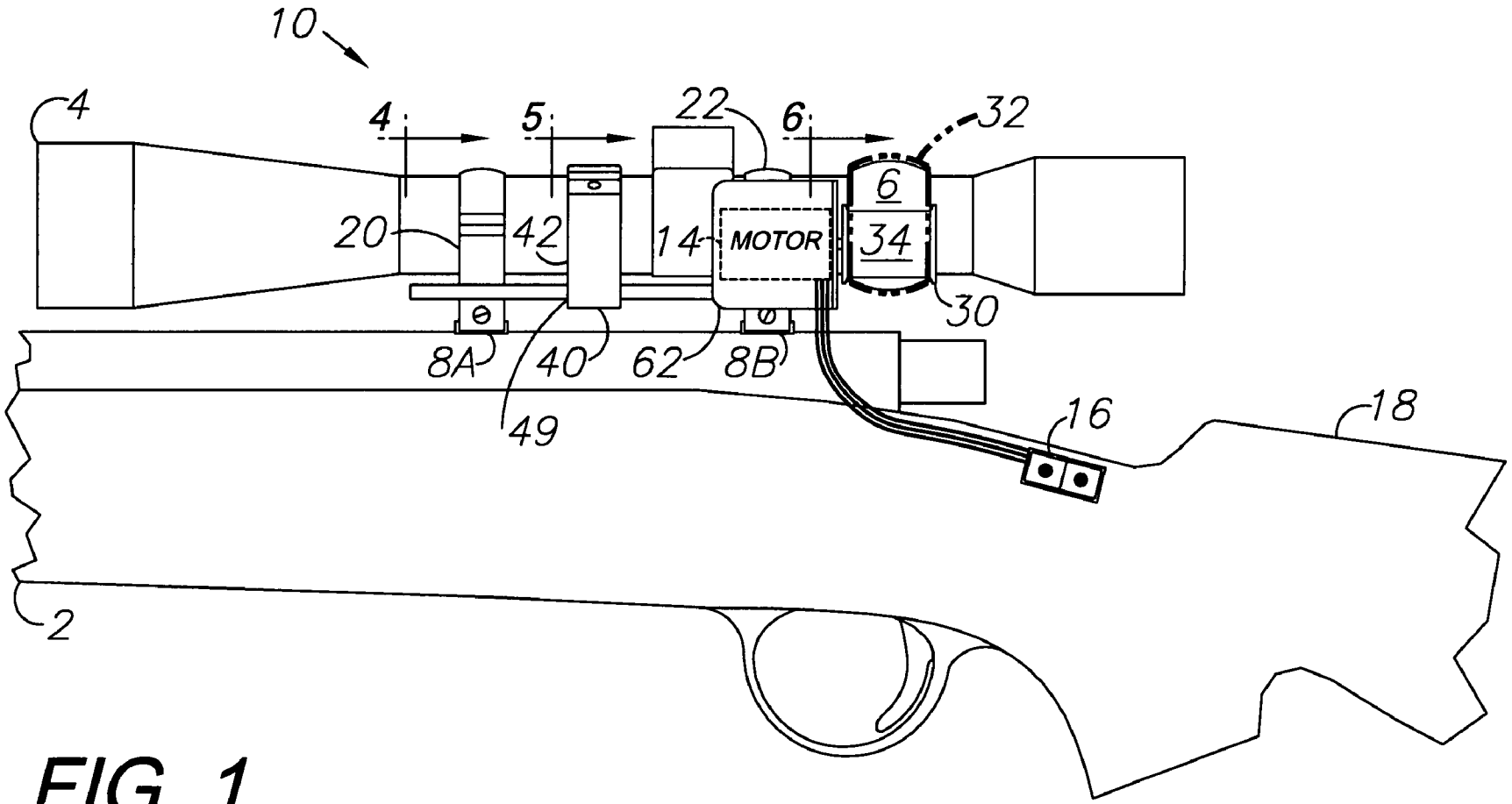
FIG. 1 is a left elevation view of an embodiment of the telescopic sight adjustment device connected to the telescopic sight of a firearm.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning.

II. Preferred Embodiment Telescopic Sight Adjustment Device 10

Referring to the drawings in more detail, the reference numeral 2 generally refers to a firearm with a telescopic sight 4 mounted thereon. Typically the telescopic sight 4 includes a telescopic adjustment ring 6. A telescopic adjustment device 10 embodying the present invention includes a power supply 12, a motor 14, a switch 16, a drive mechanism 30, a support bracket assembly 40 and a motor connection 60. The drive mechanism 30 interconnects the motor 14 and the telescopic sight 4 such that a parameter, such as magnification or focus, of the telescopic sight 4 is adjusted when the motor 14 engages the drive mechanism 30. The drive mechanism 30 could include many different electrical and/or mechanical drive configurations to engage the telescopic sight 4. Well known drive configurations include gear-to-gear and belt-and-pulley configurations, although, in the embodiments shown the drive mechanism 30 would include a frictional belt 32 and a pulley 34 configuration to manipulate a parameter of the telescopic sight 4. The motor 14 is also connected to the power supply 12.

The telescopic sight adjustment device 10 is mounted on the telescopic sight 4, which is mounted on the firearm 2. The firearm 2 may be a rifle, a handgun or another weapon, such as a crossbow. The described and depicted firearm 2 is a rifle but this should not be construed as limiting. Additionally, this application will refer to adjusting the telescopic sight 4, however, it is to be understood that the telescopic adjusting device 10 may be used to control and adjust different parameters of the telescopic sight 4 including but not limited to the zoom, focus or elevation parameters.

FIG. 1 depicts the adjustment device 10 positioned on top of the firearm 2 and adjacent to the telescopic sight 4 with the supporting bracket assembly 40. The support bracket assembly 40 could have other configurations and is not limited to the configuration depicted.

FIG. 1 also depicts the front and rear firearm scope mounts 8A, 8B respectively, which are typical connections between the telescopic sight 4 and the firearm 2. The mounts 8A, 8B are connected to first and second telescopic clamps 20, 22 respectively. The motor 14 is utilized to engage the drive mechanism 30, which adjusts the telescopic sight adjustment ring 6 located on the telescopic sight 4. The motor 14 may be operated in a single or bi-directional operation allowing the motor 14 to engage the drive 30 in a forward or reversible direction adjusting the adjustment ring as needed. The motor 14 can optionally be housed inside a motor enclosure 62. The support bracket assembly 40 is attached to the telescopic sight 4 at one or more locations and in the illustrated embodiment is attached at a front mounting subassembly 42.

FIG. 1 also illustrates the switch 16 mounted on the firearm 2. Although, the switch 16 could be mounted in a number of locations, including the stock, the barrel or the trigger mechanism, FIG. 1 illustrates the mounting of the switch 16 on a gun stock 18 with the switch 16 being electrically interconnected with the power supply to engage the motor 14. The switch can comprise, for example, a momentary contact push button switch or a single-pole, double-throw (SPDT) switch for selectively energizing the motor 14 in both directions, i.e. clockwise and counter clockwise rotations whereby the scope parameter is fully adjustable. For example, two-way, reversible motor operation enables zooming in and out by controlling magnification. Other parameters, such as focus, can also be controlled with two-way motor 14 operation using such a two-way switch 16.

Figure 2:
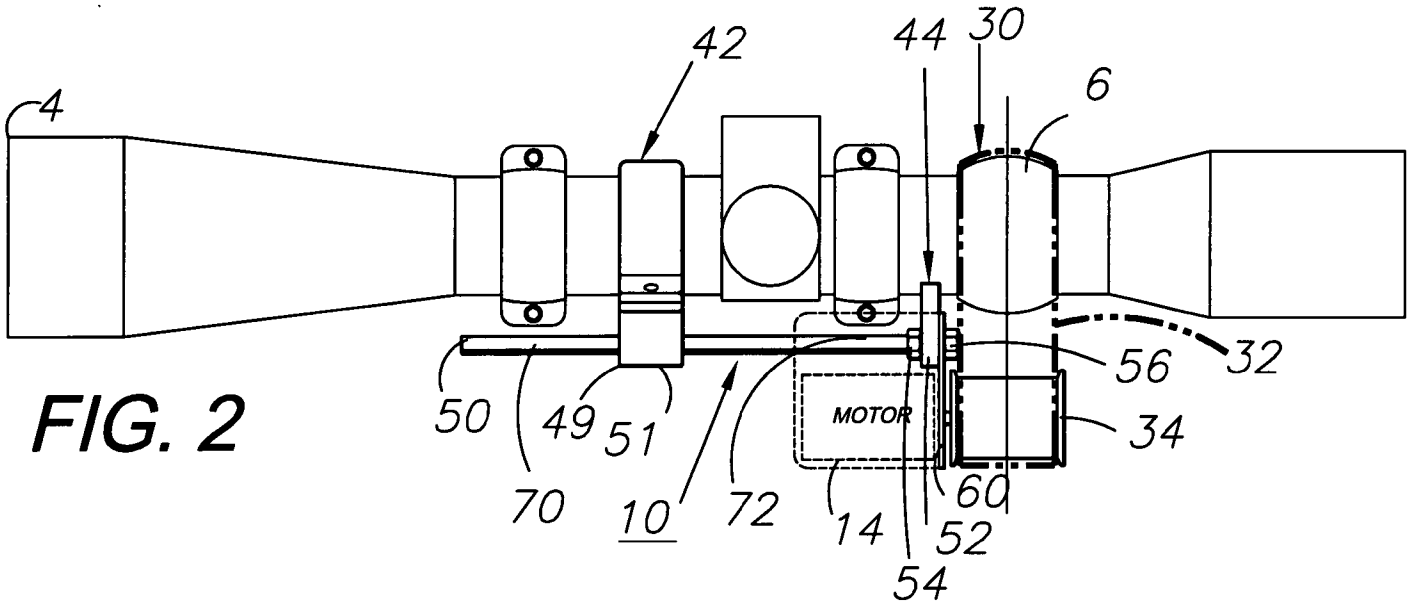
FIG. 2 is a top plan view of the device, shown without a motor and battery enclosure thereof.

As seen in FIG. 2 the support bracket assembly 40 which connects the motor 14 and mounts it onto the sight 4 such that the interconnected motor 14 and drive mechanism 30 engage the adjustment ring 6 of the telescopic sight 4. In the illustrated embodiment the support bracket assembly 40 includes the front mounting subassembly 42 and a rear mounting subassembly 44 with a rod 50 extending therebetween for longitudinally, adjustably separating the front mounting subassembly 42 from the rear mounting subassembly 44. The rod 50 parallelly mounts the support bracket assembly 40 with the telescopic sight 4 along the firearm 2.

FIGS. 1 and 2 show the front mounting subassembly 42 which is adjustably connected to the rod 50 in proximity to the rod front end 70 and includes a front supporting arm bracket or spacer 51. Although, the front supporting arm 51 of the front mounting subassembly 42 could include a number of different configurations, the front supporting arm 51 is shown shaped with a protruding boss 49 to allow the rod 50 to extend longitudinally along the firearm 2 and the front mounting subassembly 42 to be adjusted along the firearm 2 and for mounting the device 10 on the sight 4. The front mounting subassembly 42 mechanically secures the rod 50, in the illustrated figure, with a set screw 58 although other means for securing the rod 50 could be utilized. The rear mounting subassembly 44 is adapted for mounting the device 10 on the sight 4 and is connected to the rod 50 in proximity to the rod back end 72. The rear mounting subassembly 44 includes a rear supporting arm bracket or spacer 52 and front and back clamping nuts 54, 56, which are threadably mounted on the threaded back end 72 of the rod 50. The rear supporting arm bracket 52 is adapted to engage the telescopic sight 4.

In FIG. 2 the drive mechanism 30 is shown interconnecting the telescopic sight adjustment ring 6 with the motor 14. In this configuration, the rotation of the motor 14 rotates the adjustment ring 6 and thus manipulating the telescopic sight 4. The drive functionality can be accomplished with various mechanisms, such as chain-and-sprocket, direct drive and gear drives. By way of example, the drive mechanism 30 depicted in FIG. 2 consists of the belt 32 and pulley 34 with the belt 32 being adapted to engage the pulley 34 and the telescopic sight adjustment ring 6 of the telescopic sight 4. The rear mounting subassembly 44 is illustrated in FIG. 2 and includes a spacer or rear supporting arm 52 and the nuts 54, 56, which secure the rear supporting arm 52 to the rod 50 of the support bracket assembly 40. The rear supporting arm 52 is adapted to help support the device 10 and maintain the frictional tension on the belt 32 of the drive mechanism 30. The motor connection 60 connects the support bracket assembly 40 to the motor 14 and in FIG. 2 is depicted between the rear supporting arm 52 and the rear nut 56 as a rectangular plate. As depicted in FIG. 2, the drive 30 is adjacent to the motor connection 60 and encircles the telescopic sight adjustment ring 6. As the motor 14 is operated, the motor engages a gear adapted to the drive mechanism 30 which engages the telescopic sight adjustment ring 6 for manipulating the telescope parameters. Preferably the motor 14 would engage the drive 30 using a reduction geared system in which the operation of the motor 14 would indirectly engage the drive 30 and in the embodiment depicted, the gear extends outwardly from the motor 14.

Figure 3:
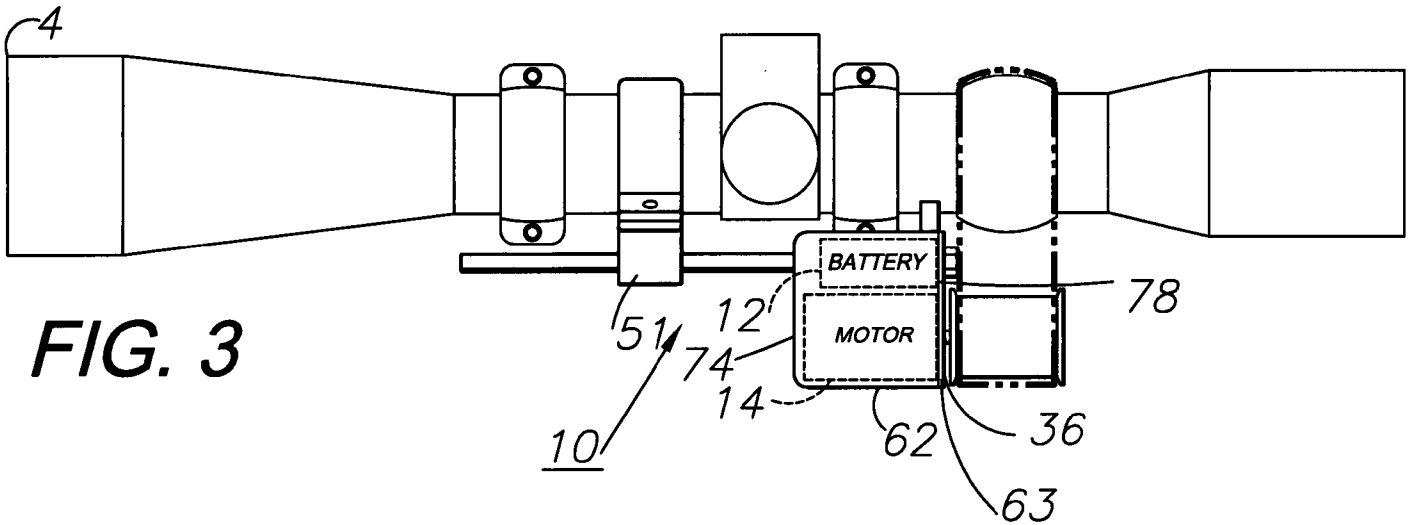
FIG. 3 is another top plan view of the device, shown with the motor and battery enclosure.

FIG. 3 illustrates the motor 14 which has a shaft 36 connected to the motor allowing the shaft 36 to rotate with the motor 14, the shaft outer end extends from the motor 14 towards the pulley 34, acting as a reduction gear between the motor 14 and the drive 30. The motor 14, which is connected to and adjacent to the power supply 12 and in juxtaposed positions. Although, the power supply 12 may include different power sources, preferably the power supply 12 would be a battery. The motor enclosure 62 houses the motor 14 and power supply 12 and helps protect the motor 14 and power supply 12 while reducing any emitted sound. Although the motor enclosure 62 may include a number of different configurations, preferably it would have a front end 74 separated from a rear end 78 and preferably at least partially enclosing said motor 14 and said power supply 12 and protecting them from the weather. The motor connection 60, as shown, is a vertically planar plate in which the motor connection 60 is mounted at the back end of the motor enclosure 62 and in which the motor connection 60 mounts the motor 14 and is clamped between the nuts 54, 56 and adjacent to the rear supporting arm 52.

Figure 4:
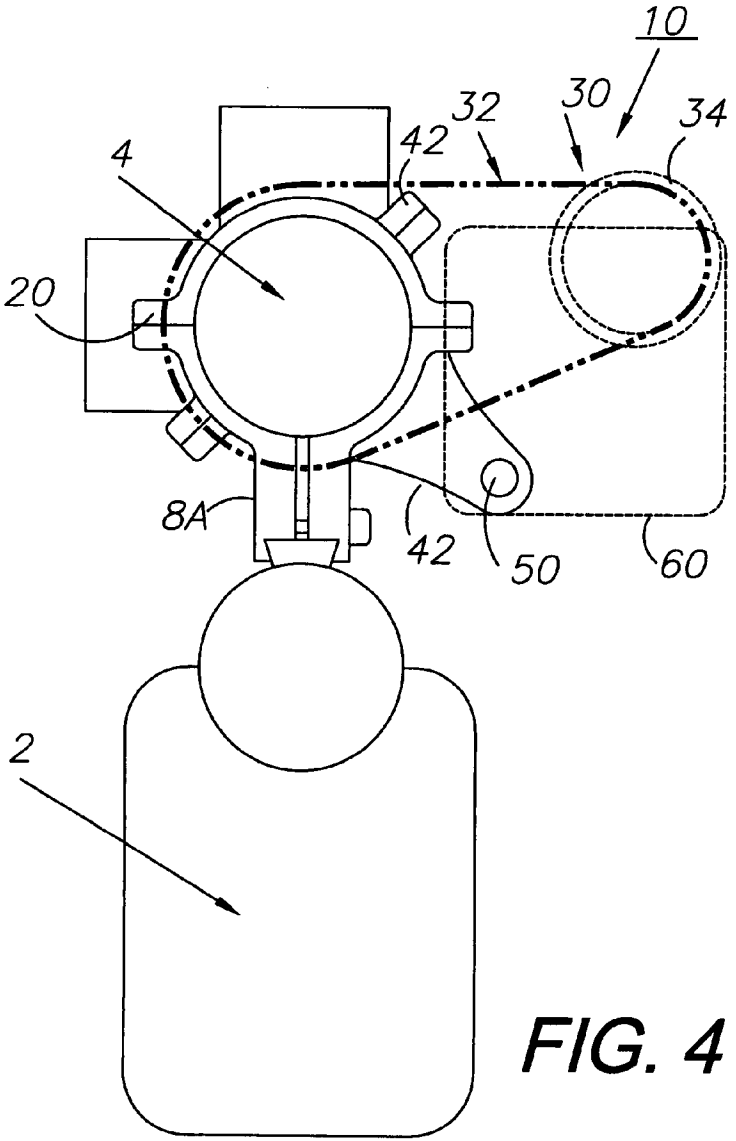
FIG. 4 is a sectional view of the device taken generally along line 4 in FIG. 1.

FIG. 4 shows a cross-sectional view of the device 10 taken generally along line 4 in FIG. 1. As shown in FIG. 4, the front firearm mounting location 8A is connected to the first telescopic clamp 20 which secures the telescopic sight 4 to the firearm 2. The front mounting subassembly bracket 42 is mounted to the telescopic sight 4 and is adjustable along the rod 50, which is received in and adjustably secured to the front mounting subassembly bracket 42 by a set screw 53 in the protruding boss 49 and the motor connection 60. The positioning of the support bracket assembly 40 helps align the telescopic sight adjustment ring 6 with the frictional belt 32 and the pulley 34.

Figure 5:
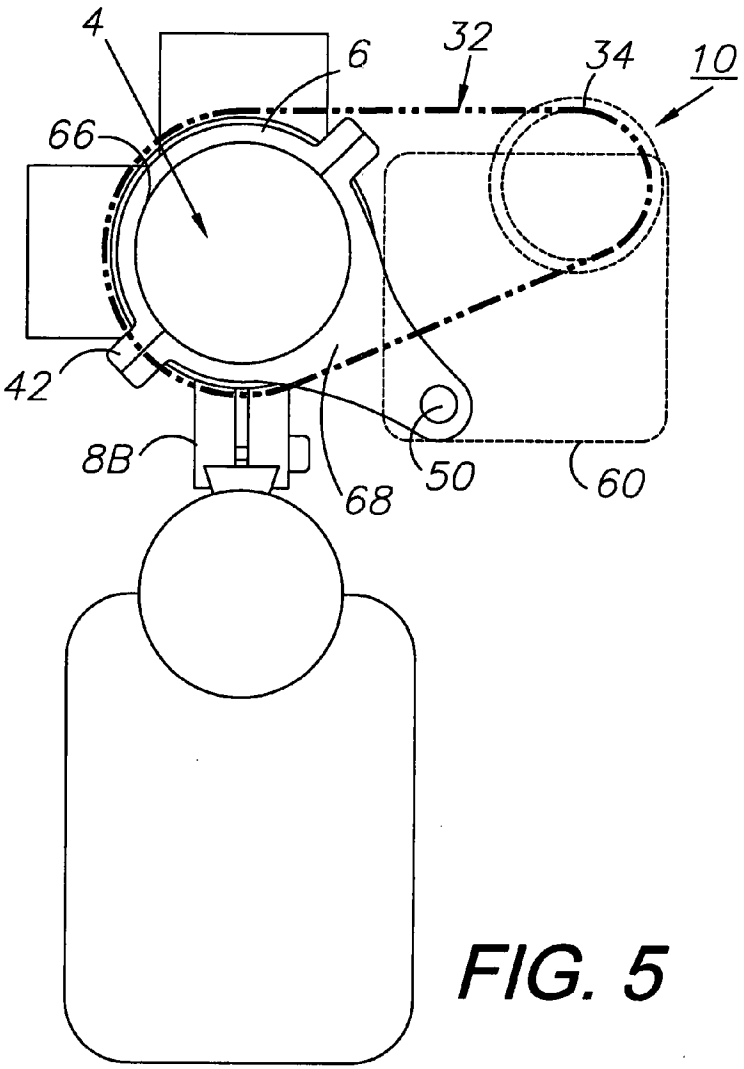
FIG. 5 is a sectional view of the device taken generally along line 5 in FIG. 1.

FIG. 5 shows a cross-sectional view of the device 10 taken generally along line 5 in FIG. 1 in which the front mounting subassembly 42 as shown includes a top front mounting clamp 66 and a bottom front clamp 68 which encircle the telescopic sight 4. FIG. 5 also shows the frictional belt 32 encircling the pulley 34 and frictionally engaging the sight 4 at the telescopic sight adjustment ring 6 for manipulating an adjustable parameter of the telescopic sight 4.

Figure 6:
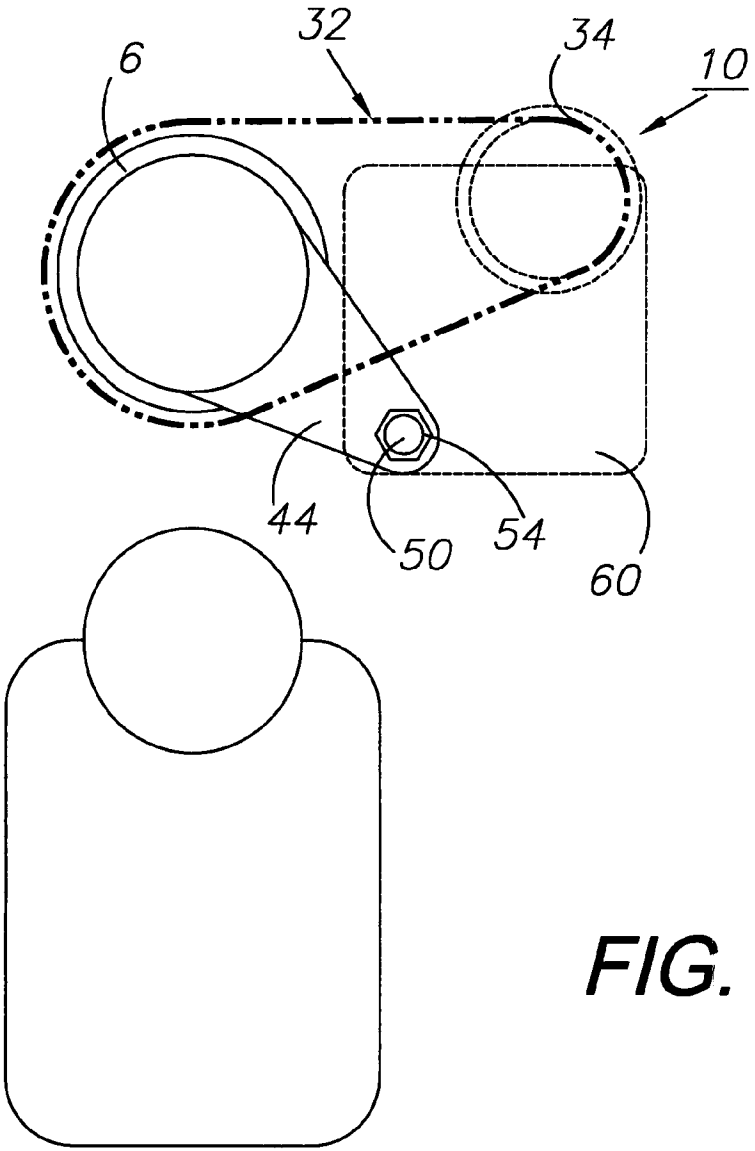
FIG. 6 is a sectional view of the device taken generally along line 6 in FIG. 1.
Figure 7:
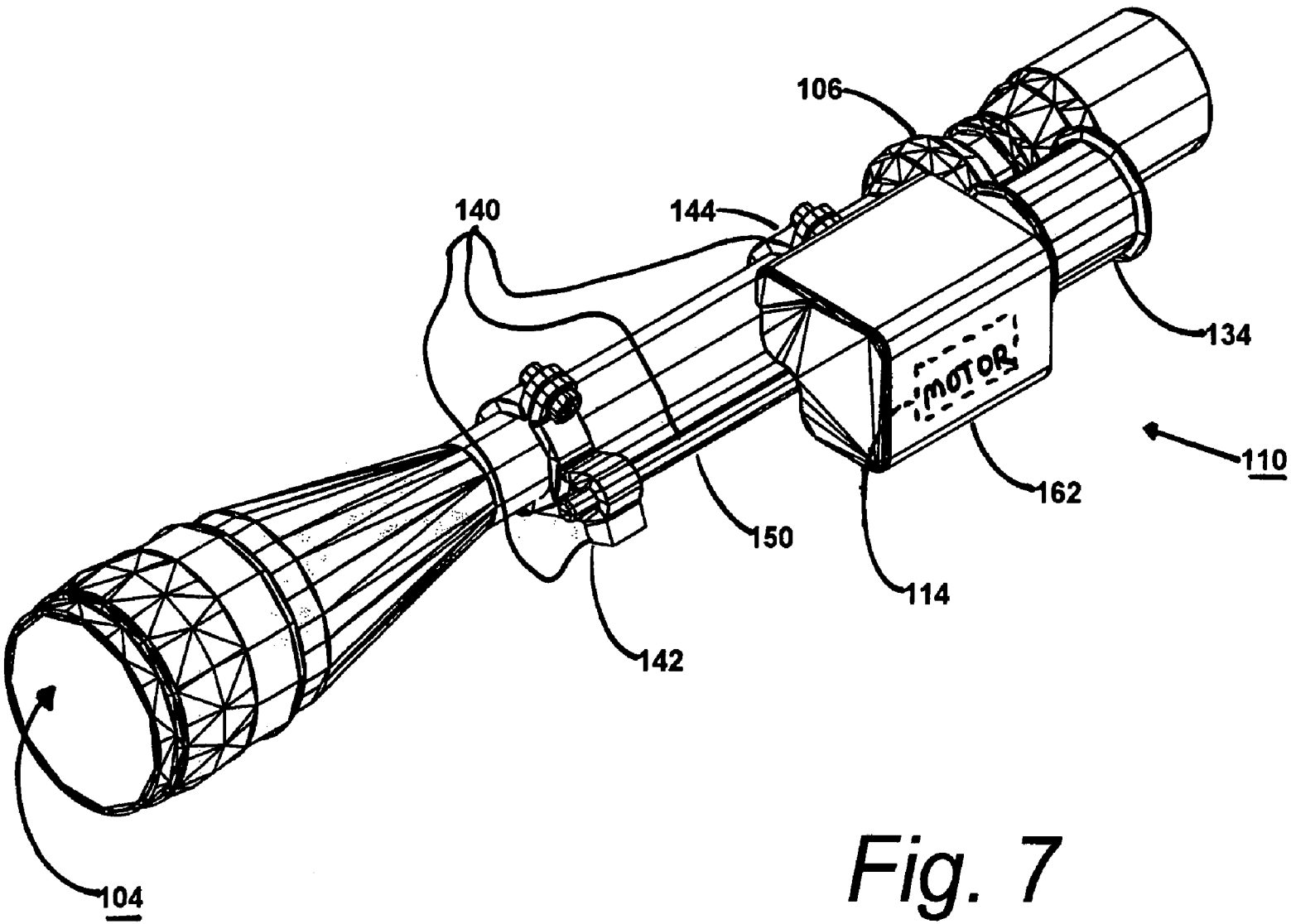
FIG. 7 is a front left side perspective view of an alternative embodiment of the telescopic sight adjustment device mounted on a telescopic sight.
Figure 8:
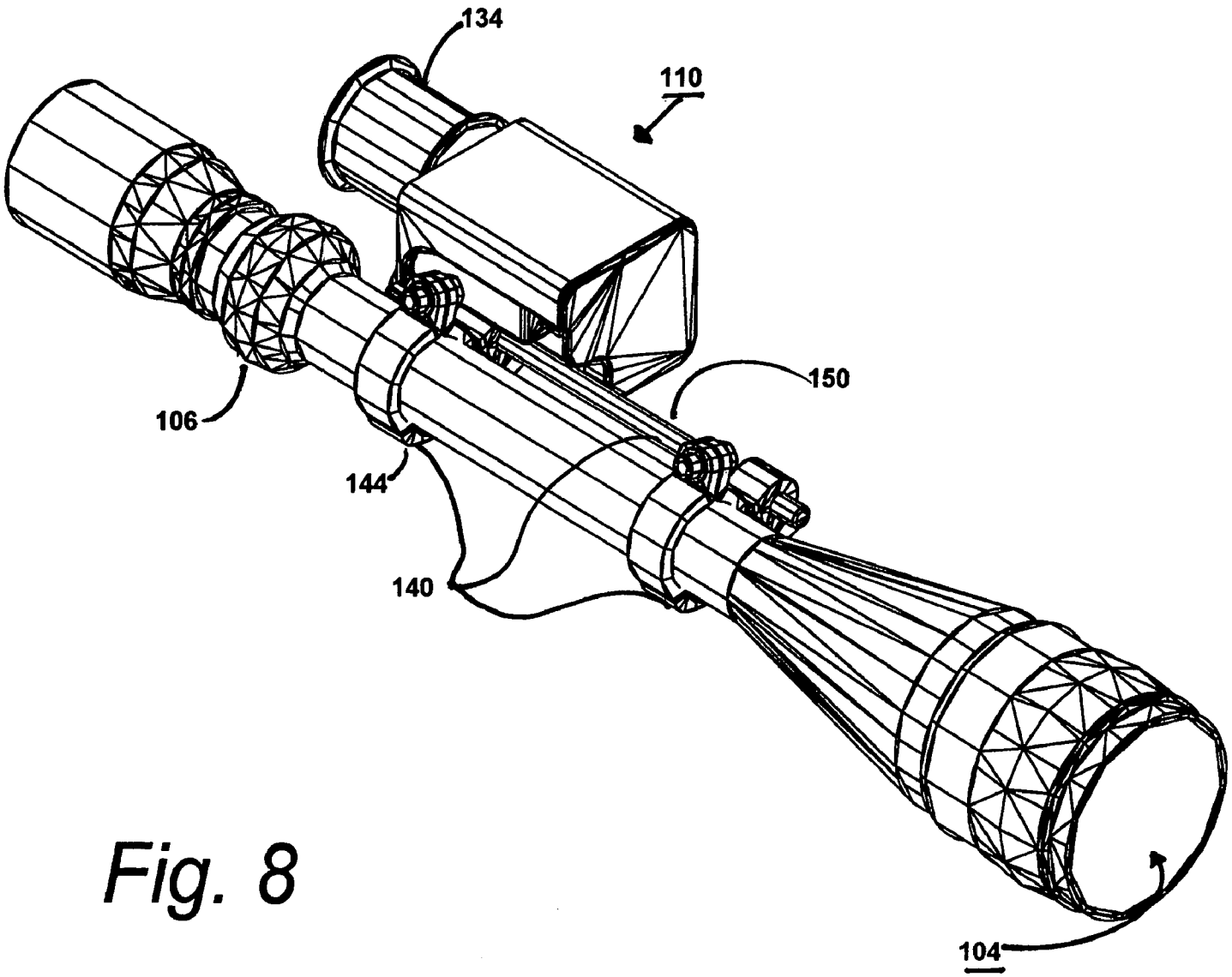
FIG. 8 is a front right side perspective view of the alternative embodiment.
Figure 9:
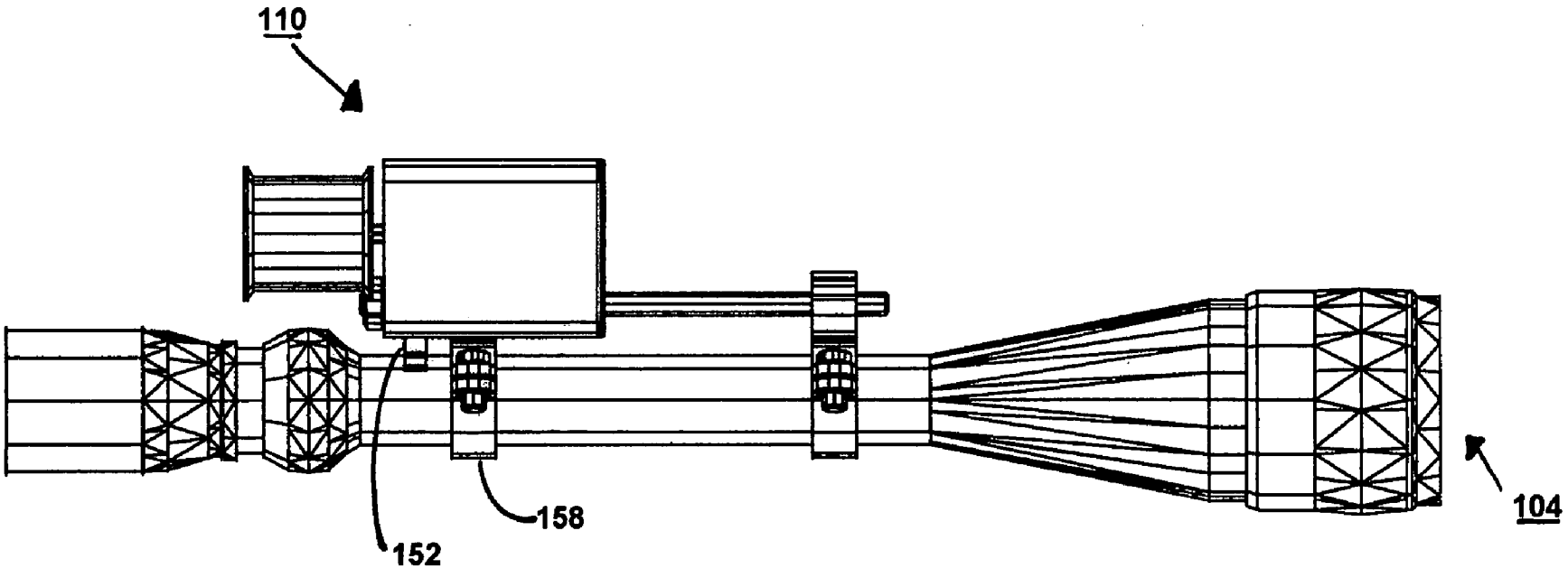
FIG. 9 is a top plan view of the alternative embodiment.
Figure 10:
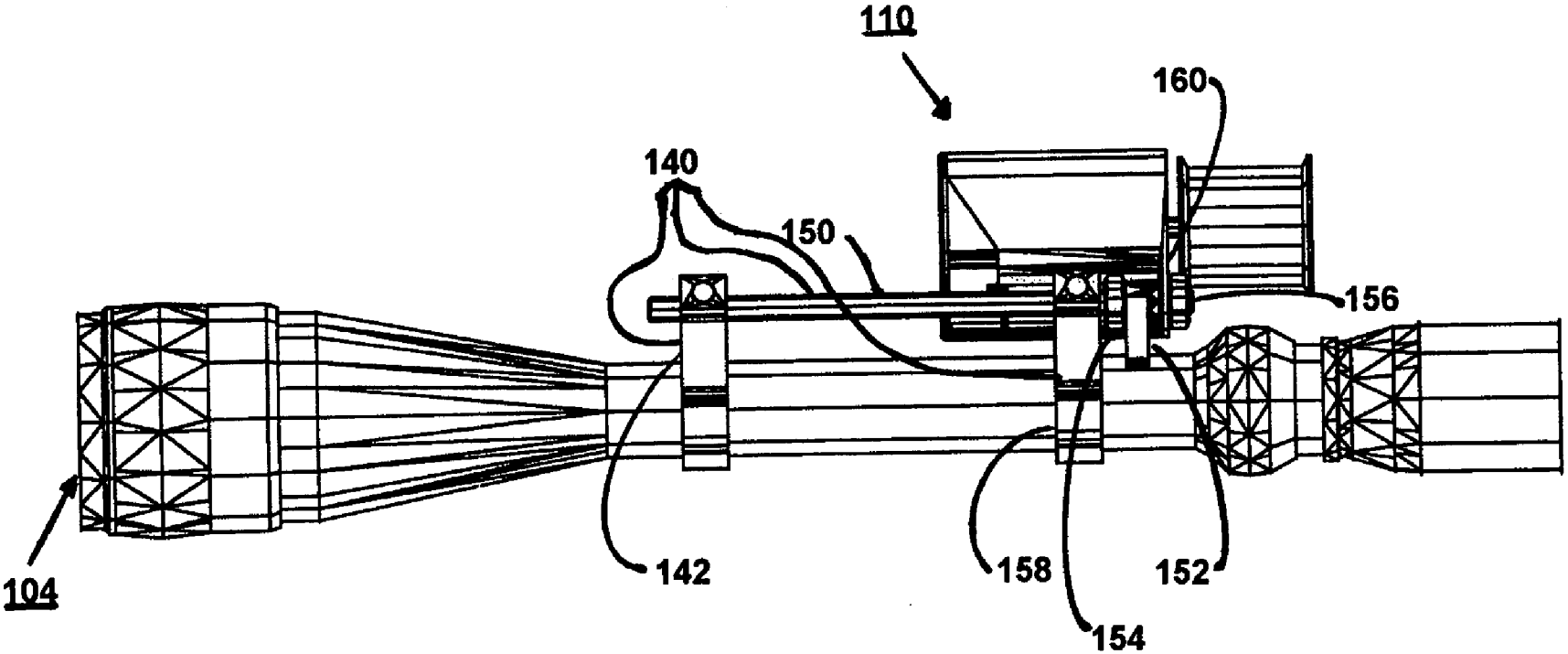
FIG. 10 is a bottom plan view of the alternative embodiment.
Figure 11:
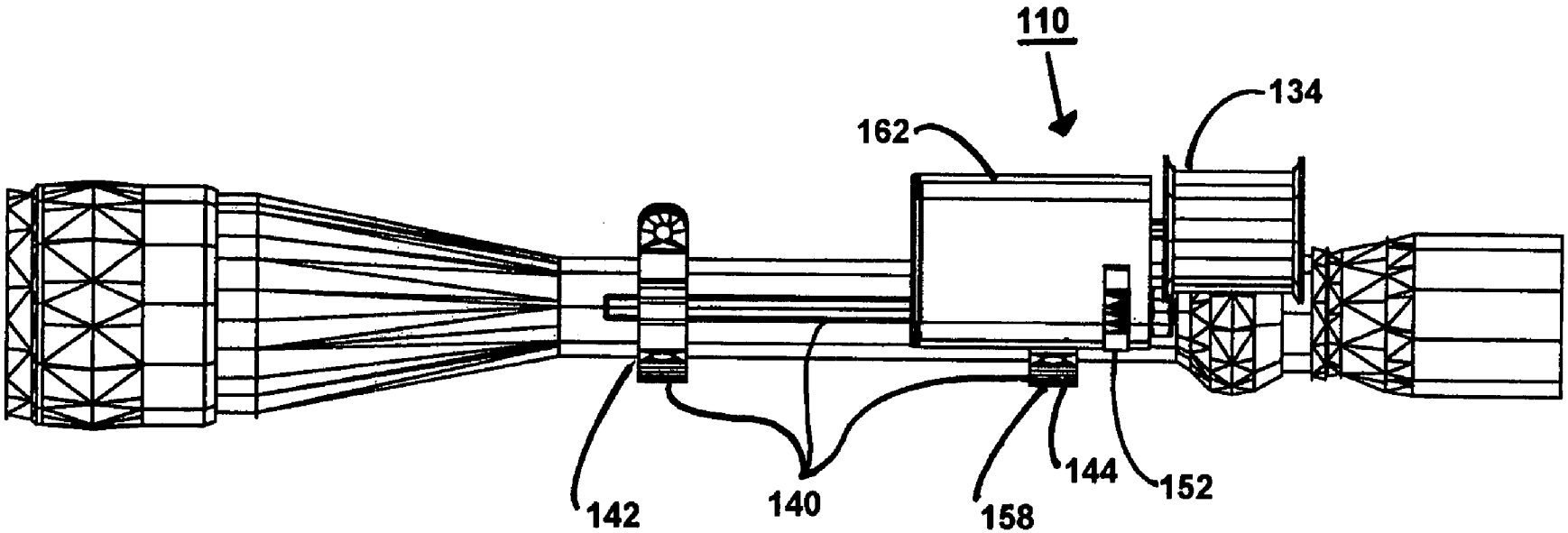
FIG. 11 is a left side elevational view of the alternative embodiment.
Figure 12:
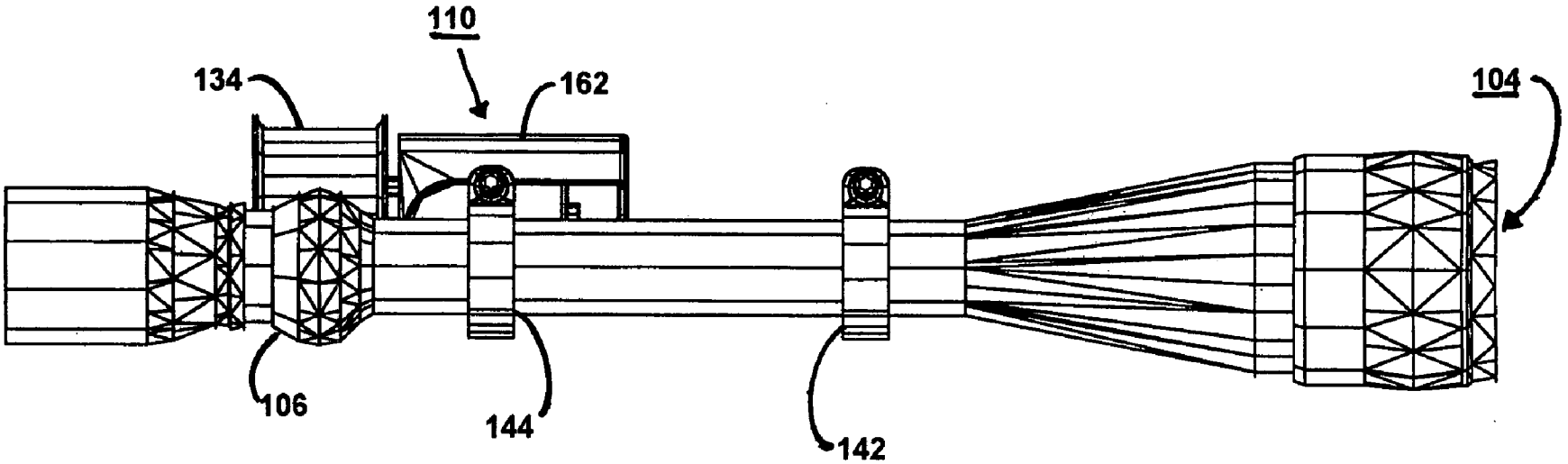
FIG. 12 is a right side elevational view of the alternative embodiment.

FIG. 6 shows a cross-sectional view of the device 10 taken generally along line 6 in FIG. 1 in which the rear supporting arm 52, which could have a number of different configurations and is not limited to the shape shown, can be seen supporting the telescopic sight 4 fastened to the rod 50 by the front nut 54. Other mechanical fasteners, such as welded joints or locking washers, can be provided in lieu of the nuts 54, 56. FIG. 6 also shows the motor connection 60 which is connected to the motor 14 and the rod 50. The motor connection 60 can be manipulated to adjust the pulley 34 and the frictional belt 32 so as to allow the drive mechanism 30 to engage the telescopic sight adjustment ring 6 of various telescopic sights 4.

III. Modified Embodiment Telescopic Sight Adjustment Device 110.

FIGS. 7–12 show a telescopic sight adjustment device 110 comprising an alternative embodiment of the present invention. A pulley 134 extends outwardly from a motor enclosure 162, which houses a motor 114. The pulley 134 is aligned so that a frictional drive belt (not shown for clarity purposes), will encircle the telescopic sight adjustment ring 106. The support bracket assembly 140 includes a front mounting bracket subassembly 142 and a rear mounting bracket subassembly 144, the front mounting bracket subassembly 142 being adjustably secured to a rod 150 which separates the front mounting bracket subassembly 142 from the rear mounting bracket subassembly 144.

The alternative embodiment device 110 is connected to a telescopic sight 104 and positioned such that the pulley 134 can manipulate the telescopic sight adjustment ring 106. The back side of a motor enclosure 162 is visible in FIG. 8 in which the rear mounting bracket subassembly 144 is depicted attached to the rod 150 of the support bracket assembly 140. The rear mounting bracket subassembly 144 includes a supporting arm 152 and a rear clamp section 158 positioned in front of the supporting arm 152 and encircling the telescopic sight 104.

The rear mounting bracket subassembly 144 includes the rear clamp section 158 and the supporting arm 152 mechanically secured to the rod 150 by front and back clamping nuts 154, 156. A motor connection 160 is sandwiched between the supporting arm 152 and the back nut 156, securing and positioning the motor enclosure 162 on the rod 150. The front mounting bracket subassembly 142 is adjustably secured to the telescopic sight 104 and the rod 150 and separated from the rear mounting subassembly 144 by the supporting arm 152. The rear clamp section 158 is secured to the telescopic sight 104. In addition, the pulley 134 can be seen extending outwardly from the motor enclosure 162.

It is to be understood that the invention can be embodied in various forms, and is not to be limited to the examples discussed above for example the battery pack could be housed in the butt of the stock. Other components and configurations can be utilized in the practice of the present invention.

Having thus described the invention, what is claimed as new and desired to be secured by Letters Patent is:

1. A device for adjusting a firearm telescopic sight including an adjustment ring, which device comprises:
   - a power supply;
   - a motor;
   - a switch electrically connected to the power supply and to the motor, said switch being adapted for selectively energizing said motor;
   - a drive interconnecting said motor and said telescopic sight adjustment ring whereby the motor is adapted for turning the adjustment ring and thereby adjusting the telescopic sight;
   - a support bracket assembly adapted for mounting said device on said sight;
   - a motor connection connecting said support bracket assembly and said motor;
   - said support bracket assembly including a front mounting bracket subassembly connected to said sight and being adapted for mounting the device on said sight at a front mounting location;
   - said support bracket assembly including a rear mounting bracket subassembly connected to said sight and being adapted for mounting the device on said sight at a rear mounting location; and
   - a rod with a front and back ends, said rod extending longitudinally between said front and back mounting bracket subassemblies, said front and back bracket subassemblies being mounted on said rod in proximity to said rod front and back ends respectively.

2. The device according to claim 1 wherein said motor connection connects said rear mounting bracket subassembly and said motor.

3. The device according to claim 1 wherein said front and rear mounting subassemblies include respective front and rear supporting arms.

4. The device according to claim 1 wherein said front mounting bracket subassembly is longitudinally, adjustably mounted on said rod.

5. The device according to claim 1 wherein said motor connection includes a plate connected to said rear mounting bracket subassembly and mounting said motor and said power supply in juxtaposed relation.

6. The device according to claim 1, which includes:
   - said motor connection comprising a plate; and
   - motor enclosure including front and back ends, said motor enclosure mounting said plate at said back end thereof, said motor enclosure at least partially enclosing said motor and said power supply.

7. The device according to claim 1 wherein, said power supply is a battery.

8. The device according to claim 1 wherein said motor further includes a rotational shaft connected to and extending outwardly from said motor and said drive includes a reduction gear mounted on said shaft.

9. The device according to claim 8 wherein said reduction gear is a pulley and said drive is a belt, wherein said pulley is operably interconnected to said belt wherein said belt encircles said pulley and engages said sight.

10. The device according to claim 9 wherein said belt frictionally manipulates the adjustment ring of the telescopic sight.

11. The device according to claim 1 wherein said motor is reversible.

12. The device according to claim 1 wherein said switch is a momentary contact push button switch adapted for mounting on the firearm such tat the user is able to adjust the telescopic sight during use.

13. The device according to claim 12 wherein said firearm further includes a stock, barrel and hand grip and said switch is positioned on said firearm at a location selected from a list of the following, the stock, the barrel or the hand grip.

14. A telescopic sight adjustment device for a firearm including a telescopic sight having an adjustment ring for manipulating a telescopic sight characteristic, said firearm having a stock, a barrel and a handgrip, said telescopic sight being fixably secured to said barrel, said telescopic sight adjustment device comprising:

a battery;

a motor with a shaft extending outwardly from said motor;

a switch electrically connected to the battery and to the motor, said switch being adapted for selectively energizing said motor;

a drive interconnecting said motor and said telescopic sight adjustment ring said drive including a pulley mounted on the motor shaft and a belt wherein said pulley is operably interconnected to said belt wherein said belt encircles said pulley and frictionally manipulates the adjustment ring of the telescopic sight;

a support bracket assembly connected to said motor and adapted for mounting said support bracket assembly on said sight, said support bracket assembly including a front mounting bracket subassembly and a rear mounting bracket subassembly, said support bracket assembly being adapted for mounting the device on said telescopic sight;

a rod wit a rod front end and a rod back end, said rod extending longitudinally between said front and rear mounting subassemblies and said front mounting bracket subassembly being adjustably connected to said rod in proximity to its front end; and a motor connection comprising a plate and a motor enclosure including front and back ends, said motor enclosure mounting said plate at said back end thereof, said motor enclosure at least partially enclosing said motor and said battery.

* * * * *